US005097987A

United States Patent [19]

Liberatore

[11] Patent Number: 5,097,987

[45] Date of Patent: Mar. 24, 1992

[54] APPARATUS FOR DISPENSING COLLAPSIBLE TUBE CONTENTS AND METHODS OF USE THEREOF

[76] Inventor: Raymond A. Liberatore, 11931 Elmrock Ave., Whittier, Calif. 90604

[21] Appl. No.: 587,738

[22] Filed: Sep. 25, 1990

[51] Int. Cl.[5] ..... B65D 35/34

[52] U.S. Cl. ..... 222/1; 222/100; 248/108

[58] Field of Search ..... 222/98-102, 222/104-105, 173, 180, 181, 391, 1; 242/54 R; 248/108, 109, 126

[56] References Cited

U.S. PATENT DOCUMENTS

| | | | |
|---|---|---|---|
| 1,692,213 | 11/1928 | Kielberg | 222/99 |
| 1,797,727 | 3/1931 | Spisa | 222/99 X |
| 2,531,060 | 11/1950 | Krueger | 222/99 |
| 2,851,195 | 9/1958 | Widmann | 222/100 |
| 3,473,698 | 10/1969 | Ballin | 222/100 |
| 3,885,708 | 5/1975 | Parry | 222/100 |
| 3,920,157 | 11/1975 | Yeung | 222/100 |
| 4,570,828 | 2/1986 | Wood | 222/100 |

FOREIGN PATENT DOCUMENTS

| | | | |
|---|---|---|---|
| 798687 | 5/1936 | France | 222/99 |
| 238430 | 10/1945 | Switzerland | 222/99 |

*Primary Examiner*—Michael S. Huppert
*Assistant Examiner*—Kenneth DeRosa
*Attorney, Agent, or Firm*—Timothy T. Tyson

[57] ABSTRACT

A dispenser (20) and method of use are shown for dispensing the contents of a collapsible tube (100). The dispenser has a reel (60) rotatably mounted within a cylinder (30). The cylinder has a slot (36) for receiving therethrough the closed end of the tube and the reel has a passageway (66) for receiving therein the same closed end. The cylinder and reel each have a knob (34, 64) with an indicator (35, 65) thereon radially aligned with the slot and passageway, respectively. A user aligns the slot and passageway using the indicators allowing the tube end to be easily inserted. Shoulders (76) on a resilient tab (74) on the reel abut a terminus (46) to retain the reel within the cylinder while allowing disassembly if desired.

5 Claims, 3 Drawing Sheets

FIG. 4
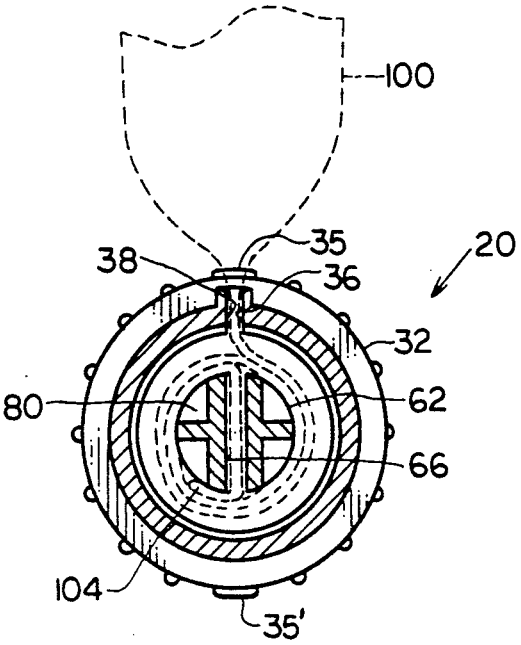
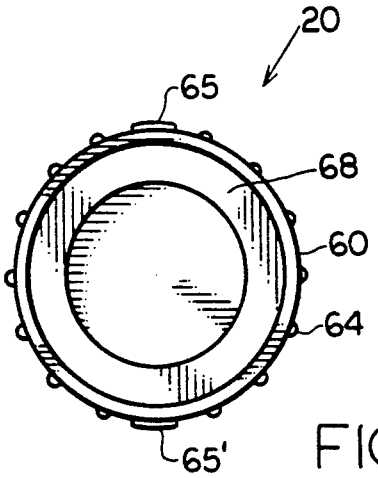
FIG. 6
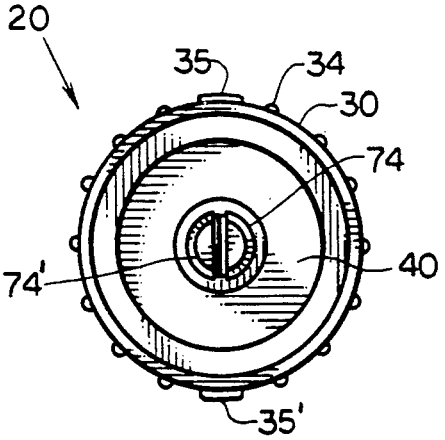
FIG. 5
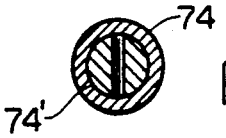
FIG. 7
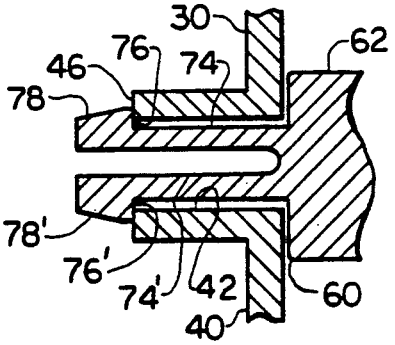
FIG. 8

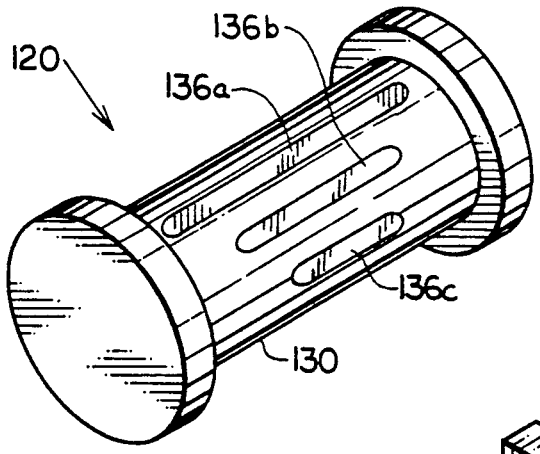
FIG. 9A
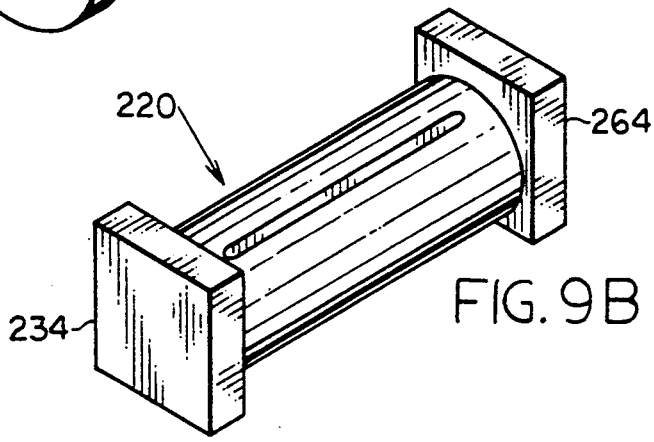
FIG. 9B
FIG. 9C
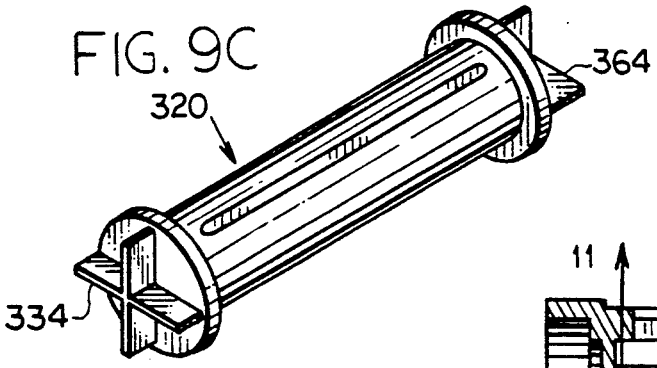
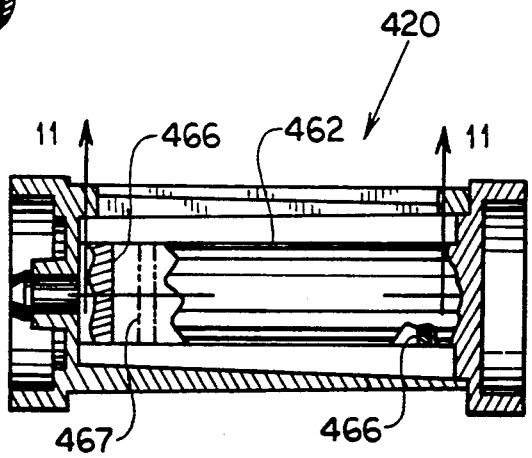
FIG. 10
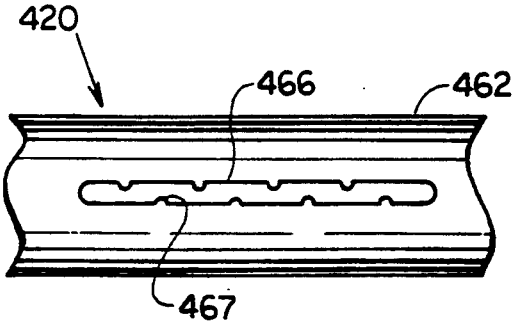
FIG. 11

APPARATUS FOR DISPENSING COLLAPSIBLE TUBE CONTENTS AND METHODS OF USE THEREOF

TECHNICAL FIELD

The present invention pertains to apparatus for dispensing collapsible tube contents.

BACKGROUND ART

Collapsible tubes are used to package many products for gradual dispensement through the open end as needed by the consumer. These products include toothpaste, hair products, lotion, medicine, glue, artist's paint and caulking. The contents are commonly dispensed from the open end of the collapsible tube by squeezing the closed end. The closed end of the collapsible tube may or may not be rolled up as the contents are dispensed. The rolling procedure, when used, is an attempt to prevent reverse flow of the contents towards the closed end. Metal and plastics are common materials for fabrication of such collapsible tubes. Plastic, in particular, has a tendency to return to its original shape and thus resists such rolling techniques.

One apparatus for collapsible tube content dispensing is described in U.S. Pat. No. 4,576,314 to Elias et al. in which a body has a pair of jaws which are squeezed against the collapsible tube while a slotted key is rotated to pull the empty tube portion through the jaws. In U.S. Pat. No. 4,653,670 to Kendrick, a U shaped clip cooperates with a blade shaped member to grasp the end of the collapsible tube. U.S. Pat. NO. 4,664,293 to Sheppard employs a mandrel, an actuator and a latch to grasp the collapsible tube end. The actuator has a handle portion against which the user can exert force to cause the tube end to wind around the mandrel.

Other background material is contained in U.S. Pat. No. 955,530 to Morrison, U.S. Pat. No. 1,770,946 to Rostiser, U.S. Pat. No. 1,986,409 to Redmer, U.S. Pat. No. 2,545,773 to Gonzalez, Great Britain Pat. No. 370,204 to Kinds, and Swiss Pat. No. 125,349 to Hediger.

DISCLOSURE OF INVENTION

The present invention is directed to a dispenser capable of ejecting the contents of a collapsible tube which has open and closed ends. Dispensers in accordance with the invention are characterized by the use of a member with an orifice through which the closed end of the tube is inserted and means for pulling the tube through the orifice thereby dispensing the contents through the open end.

In a preferred embodiment a cylinder is used for the member. The cylinder provides storage space for the portion of the tube from which the contents have been dispensed. In the cylinder the orifice is a slot so as to flatten the tube as it is pulled through the slot. The slot has beveled edges to ease the transmission of the tube through the slot.

The means for pulling, in the preferred embodiment, is a reel rotatably mounted in the cylinder. The reel has a passageway through which the closed end of the tube is inserted. When the reel is rotated relative to the cylinder the tube is wrapped about the reel and pulled through the slot.

The cylinder and the reel are provided with knurled knobs to make it easier to rotate the reel relative to the cylinder. The knurled knobs are provided with bosses to aid in radial alignment of the slot and passageway for insertion of the collapsible tube closed end. The reel has resilient tabs that engage shoulders on the cylinder to retain the reel in the cylinder.

In accordance with other embodiments, the cylinder may be provided with slots of various lengths to accommodate collapsible tubes of various diameters. In accordance with other embodiments, the knobs may be of various configurations and the passageway in the reel may have ridges for gripping the end of the tube.

Methods of use are given which include the step of pulling the closed end of the collapsible tube through a member with an orifice.

The novel features of the invention are set forth with particularity in the appended claims. The invention will be best understood from the following description when read in conjunction with the accompanying drawings.

BRIEF DESCRIPTION OF DRAWINGS

Incorporated as part of the description, in order to illustrate embodiments and principles of the present invention, are the accompanying drawings, wherein:

FIG. 4 is a sectional view similar to FIG. 3;

FIG. 5 is an end view of the dispenser of FIG. 1;

FIG. 6 is an end view of the end of the dispenser opposite that of FIG. 5;

FIG. 7 is a sectional view along the line 7—7 of FIG. 2; and

FIG. 8 is a sectional view along the line 8—8 of FIG. 2.

FIG. 9A is a view, similar to FIG. 1, of a dispenser in accordance with another embodiment of the present invention;

FIG. 9B is a view, similar to FIG. 1, of a dispenser in accordance with another embodiment of the present invention;

FIG. 10 is a view, similar to FIG. 2, of a dispenser in accordance with another embodiment of the present invention; and FIG. 11 is a view along the line 11—11 of FIG. 10.

MODES FOR CARRYING OUT THE INVENTION

Figure 1:
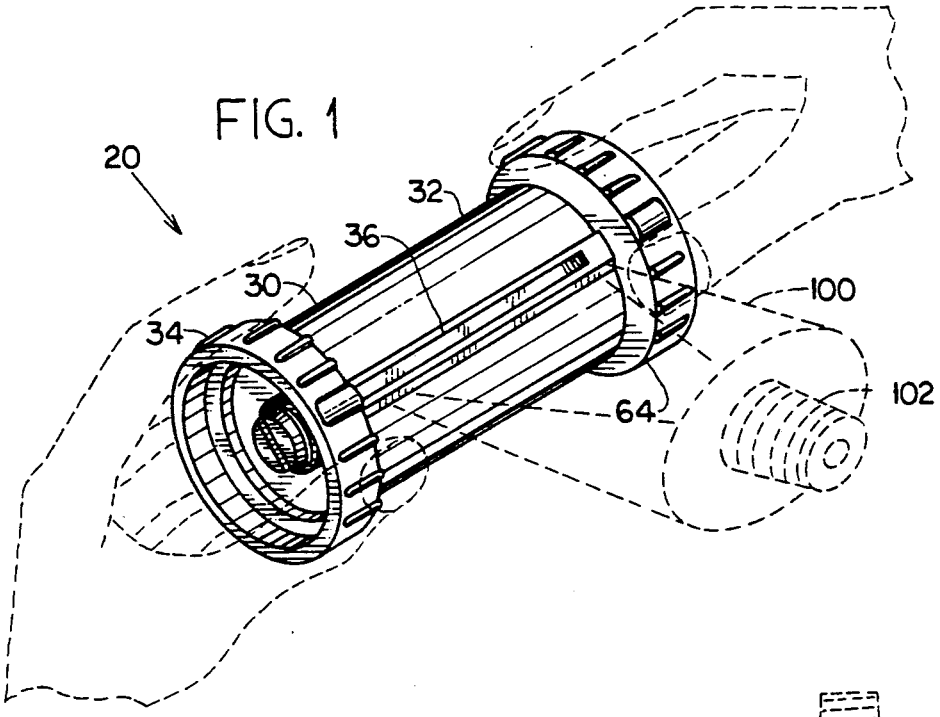
FIG. 1 is a perspective view, in accordance with an embodiment of the present invention, of a collapsible tube dispenser.

FIG. 1 is an isometric view illustrating, in accordance with an embodiment of the present invention, a dispenser 20. The dispenser 20 has a cylinder 30 whose barrel portion 32 has a knurled knob 34 at one end. Rotatably mounted in the cylinder 30 is a reel (shown in FIG. 2) also having a knurled knob 64. The barrel 32 has a slot 36 and when the knurled knobs 34 and 64 are rotated in opposite directions by the hands LH,RH the collapsible tube 100 is pulled through the slot 36 causing the contents of the tube 100 to be dispensed through the open end 102.

Figure 2:
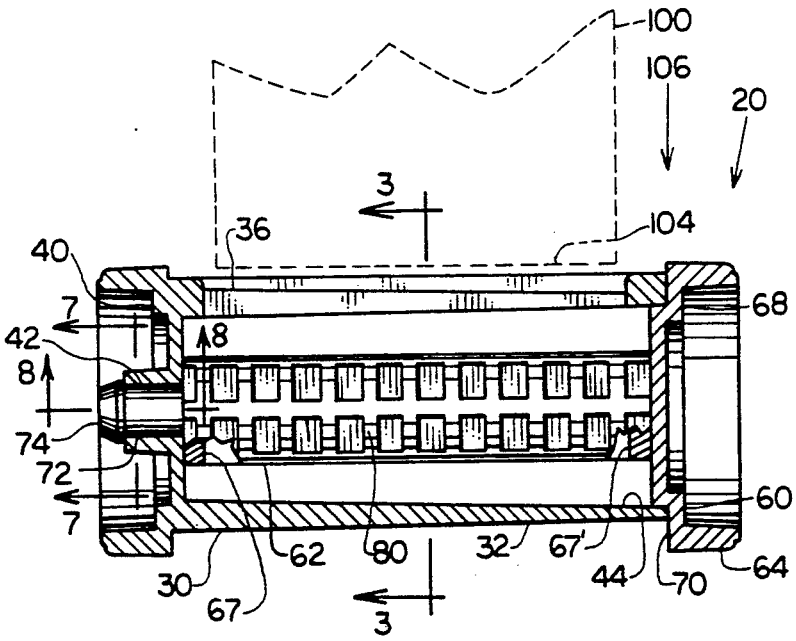
FIG. 2 is a sectional view of the dispenser of FIG. 2.

FIG. 2 is a sectional view of the dispenser 20 illustrating the cylinder 30 and its barrel 32 which has a slot 36. As stated above, pulling a collapsible tube 100 through the slot 36 will dispense the contents of the tube 100 through its open end 102. A means for pulling the tube 100 through the slot 36 is provided, in this embodiment of the invention, in the form of a cylindrical reel 60 having a knurled knob 64 on one end of a rod 62.

Figure 3:
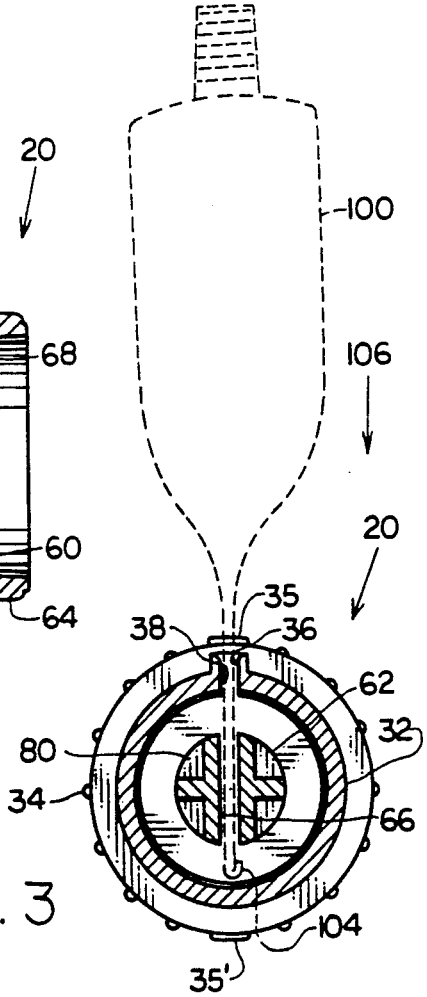
FIG. 3 is a sectional view along the line 3—3 of FIG. 2.

FIG. 3 is a sectional view along the line 3—3 of FIG. 2 showing the rod 62 within the barrel 32. The rod 62 is generally cylindrical in cross section but is locally relieved of material with gussets 80 (also shown in FIG. 2) remaining to strengthen and stiffen the rod 62. The reel 60 has a passageway 66 in its rod 62 through which the closed end 104 of the tube 100 may be placed. To ease the entry of the closed end 104, the passageway 66 is tapered outward as it approaches the surface of the rod 62. The extent of the passageway 66 normal to the line 3—3 of FIG. 2 is substantially the same as that of the slot 36 in the cylinder 30 as can be seen in the broken away portions of the rod 62 in FIG. 2 showing the ends 67, 67' of the passageway 66.

As shown in FIG. 2 the closed end 104 of the tube 100 is inserted, in the direction 106, into the slot 36 of cylinder 30 and further, as best seen in FIG. 3, into the passageway of the rod 62. As illustrated in FIG. 4, which is a similar view to FIG. 3, when the reel 60 (FIG. 2) is rotated relative to the cylinder 30 (FIG. 2) the tube 100 is wound about the rod 62 pulling the tube 100 through the slot 36 and dispensing the contents of the tube 100 through its open end 102. The edge of the slot 36 has a bevel 38 to ease the transition of the tube 100 through the slot 36 and into the outward flared entry of the passageway 66. The barrel 32 provides storage spaced for the portion of the tube 100 from which contents have been dispensed.

In FIG. 2 it can be seen that the face 68 of the reel 60 has a step 70 and that the open end 44 of the barrel 32 revolves on the step 70. The rod 62 has a journal 72 which also revolves in a bearing 42 in the end wall 40 of the cylinder 30. A tab 74 is at the end of the rod 62.

FIG. 5 is an end view of the dispenser 20 showing the end wall 40 and knurled knob 34 of the cylinder 30 and a pair of tabs 74, 74' at the end of the rod 62 (FIG. 2) that protrude through the bearing 42 (FIG. 2). FIG. 6 is a view of the end of the dispenser 30 opposite to that of FIG. 5 and shows the face 68 and the knurled knob 64 of the reel 60.

It can be seen in FIG. 3 that the knurled knob 34 of the cylinder 30 has a pair of indicators such as bosses 35,35' which align radially with the slot 36 in the barrel 32. In addition it can be seen in FIG. 3 and FIG. 6 that the knurled knob 64 of the reel 60 has a pair of indicators such as bosses 65, 65' which align radially with the passageway 66 in the rod 62. Thus by turning the knurled knobs 34, 64 until the bosses 35, 35' align radially with the bosses 65, 65', the user of the dispenser 20 aligns the slot 36 and the passageway 66, as is best seen in FIG. 3, for entry of the closed end 104 of the collapsible tube 100.

FIG. 7 is a view along the line 7—7 of FIG. 2 while FIG. 8 is a view along the line 8—8 of FIG. 2. These views illustrate the resilient tabs 74, 74' that terminate the rod 62 of the reel 60. The tabs 74, 74' are seen in FIG. 8 to have shoulders 76, 76' and chamfers 78, 78'. The chambers 78, 78' facilitate the insertion of the tabs 74,74' into the bearing 42 when assembling the reel 60 and the cylinder 30 as is best seen in FIG. 2.

The resilient tabs 74,74' urge the shoulders 78,78' against the terminus 46 of the bearing 42 thereby retaining the reel 60 in the cylinder 30. For removal of the reel 60 from the cylinder 30 the resilient tabs 74,74' may be pressed together and withdrawn through the bearing 42.

In accordance with another embodiment of the present invention, FIG. 9A is an isometric view, similar to FIG. 1, illustrating a dispenser 120 having slots 136*a*, 136*b*, and 136*c* in its cylinder 130. The length of the slots 136*a*, 136*b* and 136*c* make them suitable for use with collapsible tubes that have different diameters. FIGS. 9B and 9C, also similar views to FIG. 1, illustrate, in accordance with other embodiments of the present invention, differing shapes for the knobs 34 and 64 of the dispenser 20 (FIG. 1). FIG. 9B shows the dispenser 220 having substantially square knobs 234 and 264 which are otherwise similar to the knobs 34 and 64 of the dispenser 20. FIG. 9C shows the dispenser 320 having substantially X shaped knobs 334 and 364 which are otherwise similar to the knobs 34 and 64 of the dispenser 20.

In accordance with another embodiment of the present invention, FIG. 10, which is a view similar to FIG. 2, illustrates a dispenser 420 having a passageway 466 in its rod 462. In FIG. 11, which is a view along the line 11—11 of FIG. 10, the passageway 466 in the rod 462 is seen to have ridges 467 which protrude into the passageway 466. As can be seen in FIG. 10, the ridges 467 extend across the rod 462. The ridges in opposite sides of the passageway 466 are seen in FIG. 11 to alternate in location and thus will exert a gripping action on the closed end of a collapsible tube.

The dispensers 120, 220 and 320 of FIGS. 9A, B and C and the dispenser 420 of FIGS. 10 and 11 are otherwise similar to the dispenser 20 of FIG. 1.

It may be seen in FIGS. 1 through 8, that an embodiment of the present invention has been provided in the dispenser 20 which has means for pulling, in the form of a reel 60, a collapsible tube 100 through an orifice such as the slot 36 in the cylinder 30 so as to dispose the contents through the open end 102. The cylinder 30 and the reel 60 may be fabricated of any suitable material such as plastic. Further embodiments in the form of dispensers 120, 220, 320 and 420 have been provided as illustrated in FIGS. 9A, 9B, 9C, 10 and 11.

It may be appreciated by those skilled in the art that the reel 60 of the dispenser 20 is but one embodiment of a means for pulling the collapsible tube 100 through the slot 36 and that the cylinder 30 of dispenser 20 is also but one embodiment of a member that may have an orifice through which the collapsible tube 100 may be pulled so as to dispense its contents. Other embodiments in the form of variations of the passageway 66 of the dispenser 20 and passageway 466 of the dispenser 420 can be made without departing from the concept and scope of the invention. Likewise, other configurations of the cylinder 30 which provides storage for the used portions of the tube 100, may be used without departing from the concept and scope of the invention.

The present invention has been described with reference to preferred embodiments but, as mentioned above, numerous modifications and rearrangements can be made with the equivalent result will embraced within the scope of the invention.

What is claimed is:

1. A method of using an apparatus for dispensing contents of a collapsible tube having a closed end and an open end, comprising:

providing a dispenser having a housing and a reel, said housing having a slot and said reel having a passageway, said reel rotatably mounted in said housing, said housing having an end and said reel having an end, each said end having a knob, said housing knob having an indicator radially aligned with said slot and said reel knob having an indicator radially aligned with said passageway;

grasping said knobs;

turning said knobs to radially align said housing indicator and said reel indicator inserting said closed end of said tube through said slot and passageway; and turning said reel relative to said cylinder thereby winding said closed end about said reel and pulling said tube through said slot thus dispensing the contents of said tube through said open end of said tube.

2. A collapsible tube dispenser comprising:

a housing having a slot through which the closed end of the collapsible tube is inserted;

a reel rotatably mounted in said housing having a passageway for inserting said closed end of said tube therein whereupon turning of said reel relative to said housing winds said closed end about said reel and draws said tube through said slot thereby dispensing the contents of said collapsible tube through the open end of said tube;

said housing providing a storage space for the portion of said tube from which the contents have been dispensed;

said housing having a knob and said reel having a knob to facilitate grasping thereof and turning of said reel relative to said housing; and said housing knob having an indicator aligned radially with said slot and said reel knob having an indicator radially aligned with said passageway thereby allowing a user of said dispenser to align said slot and said passageway by aligning said housing knob indicator and said reel knob indicator.

3. A collapsible tube dispenser comprising:

a housing having a slot with beveled edges through which the closed end of the collapsible tube is inserted for causing the tube to flatten as it is pulled through said slot;

a reel rotatably mounted in said housing having a passageway having a configuration corresponding to the closed end of said tube for inserting the closed end therein whereupon turning of said reel relative to said housing winds said closed end about said reel and draws said tube through said slot thereby dispensing the contents of said collapsible tube through the open end of said tube;

said housing providing a storage space for the portion of said tube from which the contents have been dispensed;

said housing having an end having a knurled knob and a boss on said knurled knob radially aligned with said slot; and said reel having an end having a knurled knob and a boss on said knurled knob radially aligned with said passageway;

whereby said knurled knobs facilitate the grasping thereof and turning of said reel relative to said cylinder; and whereby radial alignment of said housing knob boss and said reel knob boss assure alignment of said slot and said passageway for insertion of the closed end of the collapsible tube.

4. An apparatus as defined in claim 3 wherein said cylinder has a bearing and said reel has a journal turning within said bearing.

5. An apparatus as defined in claim 4 wherein said bearing has a terminus, said journal has a resilient tab with a shoulder, and said resilient tab urges said shoulder to abut said terminus thereby retaining said reel in said cylinder, said shoulder releasing said terminus when said resilient tab pressed away from said terminus thereby releasing said reel for removal from said cylinder.

* * * * *